US009901761B2

(12) United States Patent
Chiang

(10) Patent No.: US 9,901,761 B2
(45) Date of Patent: Feb. 27, 2018

(54) CFC-FREE AND PHOSPHOR-FREE AQUEOUS FIRE EXTINGUISHING AGENT

(71) Applicants: Fung-Ming Chiang, Taipei (TW); TAIWAN SURFACTANT CORPORATION, Taipei (TW)

(72) Inventor: Fung-Ming Chiang, Taipei (TW)

(73) Assignees: CHIANG, FUNG-MING, Taipei (TW); TAIWAN SURFACTANT CORPORATION, Taipei (TW)

( * ) Notice: Subject to any disclaimer, the term of this patent is extended or adjusted under 35 U.S.C. 154(b) by 0 days.

(21) Appl. No.: 15/145,841

(22) Filed: May 4, 2016

(65) Prior Publication Data

US 2016/0375286 A1 Dec. 29, 2016

(30) Foreign Application Priority Data

Jun. 24, 2015 (TW) ..... 104120391 A

(51) Int. Cl.
*A62C 5/00* (2006.01)
*A62D 1/00* (2006.01)
*A62C 99/00* (2010.01)

(52) U.S. Cl.
CPC ..... *A62C 5/008* (2013.01); *A62C 5/00* (2013.01); *A62D 1/00* (2013.01); *A62D 1/0042* (2013.01)

(58) Field of Classification Search
None
See application file for complete search history.

(56) References Cited

U.S. PATENT DOCUMENTS 2,506,062 A * 5/1950 Busse ..... A62D 1/0071 252/3
2,529,211 A * 11/1950 Busse ..... A62D 1/0071 252/3

(Continued)

FOREIGN PATENT DOCUMENTS

CN 102886114 A 1/2013
TW 201442761 A 11/2014

OTHER PUBLICATIONS

Derwent-Acc-No. 2014-B84538; Derwent-Week: 201515.*
Derwent-Acc-No. 2013-G30809; Derwent Week: 201570.*

*Primary Examiner* — Joseph D Anthony
(74) *Attorney, Agent, or Firm* — Bacon & Thomas, PLLC

(57) ABSTRACT

The present invention provides a method for extinguishing fire, comprising: (A) preparing a CFC-free and phosphorus-free aqueous fire extinguishing agent using a composition comprising 1-70 wt % of a sulfosuccinic acid ester; 1-30 wt % of a wetting agent; and rest in water; (B) diluting the CFC-free and phosphorus-free aqueous fire extinguishing agent by water to form an aqueous solution; and (C) spraying the aqueous solution to a space containing a burning substance. The present invention not only enhances the wettability and permeability of water, but also increases its affinity to burning substances; accelerates cooling of burning substances; inhibits further combustion; reduces water for firefighting; reduces smoke and emission; mitigates environmental problems caused by haze substances from combustions on the ground and in the air and all possible related health hazards. The CFC-free and phosphorus-free aqueous fire extinguishing agent is biodegradable, non-toxic to human and environment, and easy to use.

16 Claims, 2 Drawing Sheets

(56) References Cited

U.S. PATENT DOCUMENTS

| | | | | | |
|---|---|---|---|---|---|
| 3,562,156 | A * | 2/1971 | Francen | A62D 1/0064 | 169/47 |
| 3,772,195 | A * | 11/1973 | Francen | A62D 1/0064 | 169/44 |
| 3,976,580 | A * | 8/1976 | Kaminstein | A62D 1/0064 | 169/47 |
| 5,085,786 | A * | 2/1992 | Alm | A62D 1/0085 | 169/44 |
| 5,997,758 | A * | 12/1999 | Barbarin | A62D 1/0085 | 252/3 |
| 6,379,578 | B1 * | 4/2002 | Shiga | A62D 1/0071 | 106/18.13 |
| 8,080,186 | B1 * | 12/2011 | Pennartz | A62D 1/0035 | 252/2 |
| 2003/0159836 | A1 * | 8/2003 | Kashiki | A62D 1/0064 | 169/46 |
| 2004/0206514 | A1 * | 10/2004 | Riley | A62D 1/0042 | 169/46 |

* cited by examiner

CFC-FREE AND PHOSPHOR-FREE AQUEOUS FIRE EXTINGUISHING AGENT

CROSS REFERENCE TO RELATED APPLICATION

This application claims the benefit of a foreign priority application filed in Taiwan as Serial No. 104120391 on Jun. 24, 2015, which is incorporated by reference.

BACKGROUND OF THE INVENTION

1. Field of the Invention

The present invention relates to a CFC-free and phosphorus-free aqueous fire extinguishing agent, and more particularly, to a CFC-free and phosphorus-free aqueous fire extinguishing agent for firefighting.

2. Description of the Related Art

Fire is a common hazard. It will cause damage to property, sometimes even cost lives, and cause serious environmental and health problems. How to effectively and quickly extinguish a fire while taking environmental protection and health into account is an important issue for current fire extinguishing techniques in firefighting. Each type of fire extinguishing agents has one or more of the following effects: cooling, reducing combustion temperature; blocking air from entering the combustion zone; preventing combustibles from entering the combustion zone; inhibiting chain reaction of combustion; and diluting the concentration of combustible gases or flammable liquids on site of a fire.

Currently, the main types of fire extinguishing agents can be divided into water, foam, carbon dioxide, dry powder, haloalkane, and special fire extinguishing agents. Among them, the traditional chemical foam fire extinguishing agent is a firefighting foam produced from a chemical reaction caused by mixing a basic salt solution and an acidic salt solution. The fire extinguishing effect of the foam fire extinguishing agent is attributed to its isolating and cooling functions. In general, the gas contained in the foam fire extinguishing agent is carbon dioxide. The carbon dioxide fire extinguishing agent is usually stored in a cylinder in a liquid form. The main functions of the carbon dioxide fire extinguishing agent in firefighting are suffocation and cooling. The dry powder fire extinguishing agent fights fire mainly by spraying specific inorganic salts (such as ammonium dihydrogen phosphate, etc.) to suppress the chain reaction of combustion. However, the dry powder fire extinguishing agent may pollute water and land resources easily. The haloalkane fire extinguishing agent is the compound produced by substituting a part or all of the hydrogen atoms of a certain lower alkane compound with halogen atoms. The halogen atoms of the haloalkane fire extinguishing agent are typically fluorine, chlorine, or bromine atoms. However, haloalkane vapor is poisonous and inhalation of the vapor or skin contact with the vapor must be avoided when using the haloalkane fire extinguishing agent.

As mentioned above, each type of the aforesaid fire extinguishing agents has environmental concerns except water. Water is an environmentally friendly and economical fire extinguishing agent since the source of water is rich, water can be accessed conveniently, and water is a cheaper fire extinguishing agent. Except for combustions in which water is completely inapplicable to, water should be preferentially selected for use as a fire extinguishing agent. The functions of water in firefighting are mainly as follows: cooling, emulsification, isolation, dilution, and collision. Although water extinguishes fire not only by a single aforesaid function but a combination of more than one of the aforesaid functions, cooling is the main aforesaid function of water in firefighting. Therefore, how to enhance the cooling function of water is important when water is used as a fire extinguishing agent.

Even though water molecule has a very high thermal stability, making water to be the most widely used fire extinguishing agent; however, the physical property of water poses restrictions to its firefighting application. For example, due to the high surface tension of water (72.8 mN/m, 20° C.), the affinity of water to many substances is very low under normal circumstances. In other words, the wettability of water is low; thus, it is not easy for water to contact many substances, especially the surface of hydrophobic substances (such as tire rubber, plastics, solvent, oil, gas, etc.). This property of water reduces the possibility of water to stay on the surface of a burning substance. In addition, water has low permeability. Even when water is dispersed as a water mist, water still cannot enter the recesses and the interior of a burning substance. Hence, even when a great amount of water is used, these physical properties of water will cause the cooling function of water to be insufficient for firefighting. Firefighting may then be delayed and water will be wasted, resulting in negative effects, such as harming human life and polluting air and soil. As a result, water cannot exert its cooling function to reduce temperature for firefighting merely by its natural physical properties.

Moreover, when water is used in firefighting, water is discharged to the combustion zone or the combustion surface through a spraying device. Different spraying devices discharge different forms of water. Different patterns of water flow have different firefighting effects. The spraying devices of water for firefighting can be typically categorized into types of: dense water flow, flowering water flow, mist-spraying water flow, and steam. As currently known, due to the poor dispersion of dense water flow, water can only contact flames or burning substances in small areas at the high temperature fire site. Consequently, water cannot fully exert its cooling function, decreasing its fire extinguishing effect. Mist-spraying water flow is pressurized and sprayed out from a mist-sprayer through a high pressure fire pipe or a pump. Since water mist, which has a water droplet diameter of less than 100 μm, has the greatest specific surface area and better heat capacity, water mist can be vaporized rapidly to form steam in flames so as to extinguish fire directly by cooling. However, water mist has poor permeability into flames. Most of water mist is completely vaporized when passing through flames; thereby, the cooling function of water mist is not sufficient in the early phase of firefighting.

Furthermore, the fire site is a high temperature area, and thus, water is vaporized very easily unless a great amount of water is employed. High temperature steam can easily increase the temperature of flammable substances, which will cause more disasters in firefighting, especially in regions lacking water.

Accordingly, in view of the aforesaid fire extinguishing agents, it can be found that each one of the current fire extinguishing agents has drawbacks. However, the frequency of fire is increasing and water resource is decreasing, resulting in serious environmental and climate problems as well as harming human health. Therefore, a novel CFC-free and phosphorus-free aqueous fire extinguishing agent, which is efficient, fast, non-toxic to human and environment, and easy to use, is needed.

SUMMARY OF THE INVENTION

A main object of the present invention is to provide a CFC-free and phosphorus-free aqueous fire extinguishing agent comprising sulfosuccinic acid ester and a wetting agent in fire fighting. The CFC-free and phosphorus-free aqueous fire extinguishing agent is diluted by water and sprayed to a burning substance. The CFC-free and phosphorus-free aqueous fire extinguishing agent provided by the present invention not only improves the wettability and permeability of water, but also enhances affinity of water to burning substances; accelerates temperature reduction of the burning substances; inhibits further combustion; reduces the amount of water for firefighting; reduces smoke and emission; and mitigates the environmental problems caused by haze substances from combustions on the ground and in the air and all possible related health hazards. The spraying method of the CFC-free and phosphorus-free aqueous fire extinguishing agent may be by sprinkling or mist-spraying. The CFC-free and phosphorus-free aqueous fire extinguishing agent does not contain any heavy metals, phosphorus compounds, and fluorine compounds. The CFC-free and phosphorus-free aqueous fire extinguishing agent is biodegradable and non-toxic to human and environment as well as easy to use.

To achieve the aforesaid object, the present invention provides a use of a composition for preparing a CFC-free and phosphorus-free aqueous fire extinguishing agent. The composition comprises: 1-70 percent by weight (hereinafter, wt %) of a sulfosuccinic acid ester; 1-30 wt % of a wetting agent; and rest in water.

To achieve the aforesaid object, the present invention also provides a method for extinguishing fire, which comprises: (A) preparing a CFC-free and phosphorus-free aqueous fire extinguishing agent using a composition, wherein the composition comprises: 1-70 wt % of a sulfosuccinic acid ester; 1-30 wt % of a wetting agent; and rest in water; (B) diluting the CFC-free and phosphorus-free aqueous fire extinguishing agent by water to form an aqueous solution; and (C) spraying the aqueous solution to a space containing a burning substance.

In the method for extinguishing fire provided by the present invention, the sulfosuccinic acid ester is an alkyl sulfosuccinic acid ester. The alkyl sulfosuccinic acid ester may be a monoalkyl sulfosuccinic acid ester, a dialkyl sulfosuccinic acid ester, a multi-alkyl sulfosuccinic acid ester, or a combination thereof. Among them, the monoalkyl sulfosuccinic acid ester may have an alkyl group having a carbon chain of 1 to 18 carbon atoms, preferably 4 to 12 carbon atoms, and more preferably 6 to 8 carbon atoms; the dialkyl sulfosuccinic acid ester may have an alkyl group having a carbon chain of 1 to 18 carbon atoms, preferably 4 to 12 carbon atoms, and more preferably 6 to 8 carbon atoms; and the multi-alkyl sulfosuccinic acid ester may have an alkyl group having a carbon chain of 1 to 18 carbon atoms, preferably 4 to 12 carbon atoms, and more preferably 6 to 8 carbon atoms. The alkyl sulfosuccinic acid ester may have the following formula:

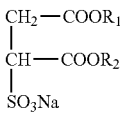

wherein $R_1$ and $R_2$ are different or same alkyl groups.

In the method for extinguishing fire provided by the present invention, the wetting agent may be an alkyl monohydric alcohol, an alkyl diol, an alkyl polyol, a polyether derivative of an alkyl diol, or a combination thereof. Among them, the alkyl group may have a linear or branched carbon chain having 1 to 18 carbon atoms, preferably 1 to 12 carbon atoms, and more preferably 1 to 6 carbon atoms.

The water used in the present invention is not particularly limited, and preferably, it may be pure water or distilled water.

In the method for extinguishing fire provided by the present invention, the CFC-free and phosphorus-free aqueous fire extinguishing agent is free of heavy metals and chloride ions. In addition, the CFC-free and phosphorus-free aqueous fire extinguishing agent is biodegradable.

In the method for extinguishing fire provided by the present invention, the dilution method is not particularly limited and any conventional dilution method may be used. The dilution of the CFC-free and phosphorus-free aqueous fire extinguishing agent by water is not particularly limited either. Preferably, a weight ratio of the CFC-free and phosphorus-free aqueous fire extinguishing agent to water is 1:100000 to 1:10.

In the method for extinguishing fire provided by the present invention, the method used to spray the aqueous solution obtained from step (B) to the space containing the burning substance is not particularly limited. Any conventional spraying method may be used. Preferably, the aqueous solution is sprayed to the space containing the burning substance by sprinkling or mist-spraying. The direction for spraying the aqueous solution to the space containing the burning substance is not particularly limited either. Preferably, the aqueous solution is sprayed from top to bottom in the air to the space containing the burning substance. The dosage of the CFC-free and phosphorus-free aqueous fire extinguishing agent provided by the present invention is not particularly limited. In general, the dosage for sprinkling or mist-spraying a fire extinguishing agent depends on the property and the amount of the burning substance. The dosage is usually determined by tests and experiments. Since the CFC-free and phosphorus-free aqueous fire extinguishing agent exerts its wetting effect to the space containing the burning substance, its dosage depends on the properties, amounts, areas, and distributions of different burning substances in the space. The burning substance may be a gas, a liquid, a solid, or a combination thereof, but not limited thereto. The space containing the burning substance is not particularly limited and may be any space or any area containing a burning substance. However, the space containing the burning substance is preferably a region above or in the burning substance.

DETAILED DESCRIPTION OF THE PREFERRED EMBODIMENT

The following content describes the details of the present invention in accordance with certain embodiments. Those skilled in the art can easily realize other advantages and functions of the present invention from the following disclosure. The present invention can also be performed or practiced by other different embodiments. Regarding different views and applications, numerous variations and modifications can be made to the present disclosure without departing from the spirit of the present invention.

Figure 1:
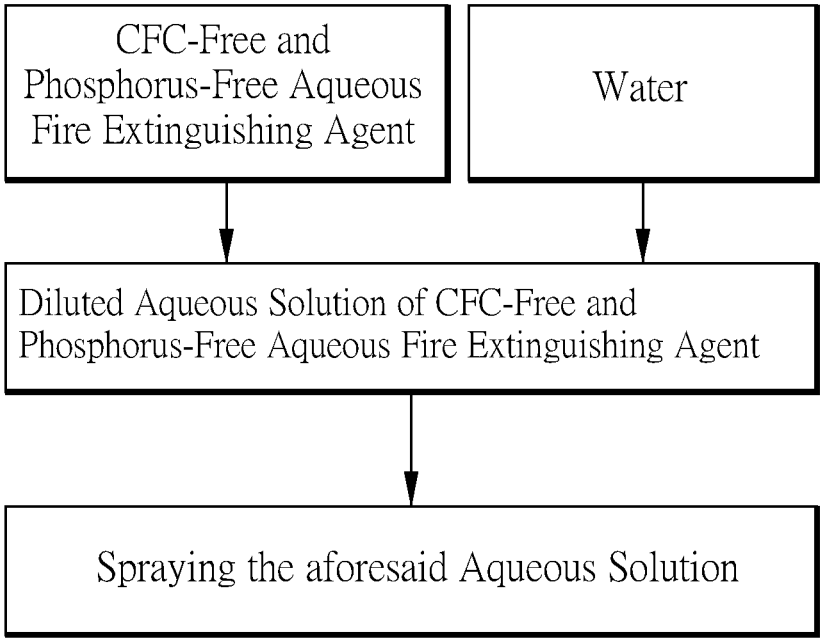
FIG. 1 is a schematic diagram illustrating a method for using the CFC-free and phosphorus-free aqueous fire extinguishing agent provided by the present invention.

Please refer to FIG. 1. FIG. 1 is a schematic diagram illustrating a method for using the CFC-free and phosphorus-free aqueous fire extinguishing agent provided in the present invention. As shown in FIG. 1, in a preferred embodiment of the present invention, the CFC-free and phosphorus-free aqueous fire extinguishing agent provided by the present invention is diluted by water. The diluted aqueous solution of the CFC-free and phosphorus-free aqueous fire extinguishing agent is then sprayed. Preferably, the aqueous solution of the CFC-free and phosphorus-free aqueous fire extinguishing agent is sprayed by sprinkling or mist-spraying onto or into a space containing a burning substance. A fire is then extinguished and the environmental problems caused by the burning substance and all possible related health hazards are then mitigated.

In other words, a fire can be extinguished by the following steps:

(a) the CFC-free and phosphorus-free aqueous fire extinguishing agent provided by the present invention is highly diluted by water to form an aqueous solution; and (b) the aqueous solution from step (a) is sprayed, such as by sprinkling on or mist-spraying to, a space containing a burning substance, preferably from top to bottom in the air to an upper region or an internal region of the space containing the burning substance, by an appropriate sprinkling or mist-spraying nozzle or an appropriate sprinkler or mist-sprayer.

Figure 2:
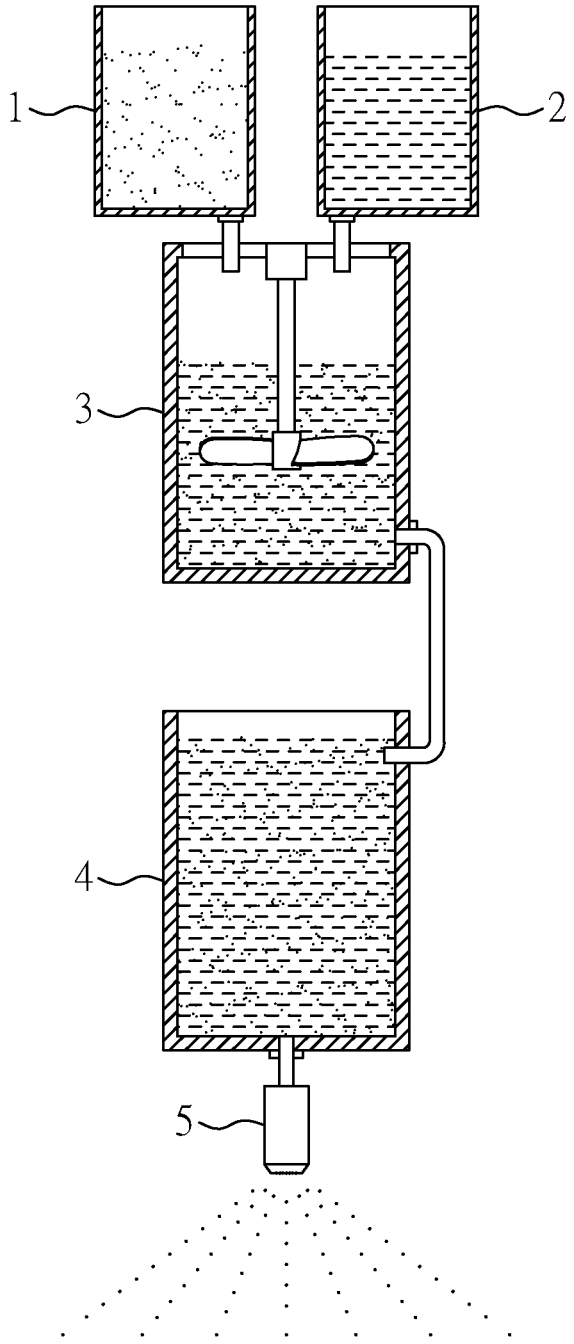
FIG. 2 is a schematic diagram illustrating a device containing the CFC-free and phosphorus-free aqueous fire extinguishing agent provided by the present invention.

Please refer to FIG. 2. FIG. 2 is a schematic diagram illustrating a device containing the CFC-free and phosphorus-free aqueous fire extinguishing agent provided by the present invention. As shown in FIG. 2, in a preferred embodiment of the present invention, the CFC-free and phosphorus-free aqueous fire extinguishing agent provided by the present invention is disposed in a first tank 1. Water is disposed in a second tank 2. The first tank 1 and the second tank 2 are each connected to a third tank 3. The third tank 3 comprises a stirrer. The stirrer stirs the CFC-free and phosphorus-free aqueous fire extinguishing agent from the first tank 1 and the water from the tank 2 to form a diluted aqueous solution of the CFC-free and phosphorus-free aqueous fire extinguishing agent. The diluted aqueous solution of the CFC-free and phosphorus-free aqueous fire extinguishing agent is further disposed in a fourth tank 4 connected to the third tank 3. A spraying device 5, preferably a sprinkling or mist-spraying nozzle or a sprinkler or mist-sprayer, connected to the fourth tank 4. The spraying device 5 sprays, such as sprinkles or mist-sprays, the diluted aqueous solution of the CFC-free and phosphorus-free aqueous fire extinguishing agent to a space containing a burning substance. Preferably, the diluted aqueous solution of the CFC-free and phosphorus-free aqueous fire extinguishing agent is sprayed from top to bottom in the air to an upper region or an internal region of the space containing the burning substance.

A few embodiments of the CFC-free and phosphorus-free aqueous fire extinguishing agent provided by the present invention are as follow:

Example 1

CFC-Free and Phosphor-Free Aqueous Fire Extinguishing Agent

| Composition | Percentage |
|---|---|
| di-isooctyl sulfosuccinic acid ester | 70.0 |
| propylene glycol | 10.0 |
| pure water | 20.0 |

The CFC-free and phosphorus-free aqueous fire extinguishing agent as described above was diluted by distilled water to form a 1 wt % aqueous solution. The aqueous solution was mist-sprayed to a region above or in the burning substance. After mist-spraying, observation was done at certain time intervals and the fire extinguishing effect was assessed.

Observation on Test Site

| Burning Substance Tested: two wide rubber bands | Pure Water Mist-Spray (0.2 mL per spray) | Mist-Spray with CFC-Free and Phosphorus-Free Aqueous Fire Extinguishing Agent added (0.1 mL per spray) |
|---|---|---|
| began mist-spraying after fire started | fire continued after 10 sprays<br>fire was extinguished completely after additional 1 mist-spray with the agent added<br>fire smoke was hardly reduced | fire was extinguished immediately and completely after 2 sprays<br>fire smoke was reduced immediately |

As shown in the table above, the fire on the burning substance (wide rubber bands) was not extinguished by the pure water mist-spray. The mist-spray with the agent added was able to extinguish fire rapidly and completely in a remarkably and relatively small amount. In addition, the mist-spray with the agent added was able to reduce fire smoke immediately.

Example 2

CFC-Free and Phosphor-Free Aqueous Fire Extinguishing Agent

| Composition | Percentage |
|---|---|
| di-octyl sulfosuccinic acid ester | 35.0 |
| octyl sulfosuccinic acid ester | 35.0 |
| diethylene glycol | 10.0 |
| pure water | 20.0 |

The CFC-free and phosphorus-free aqueous fire extinguishing agent as described above was diluted by distilled water to form a 1 wt % aqueous solution. The aqueous solution was mist-sprayed to a region above or in the burning substance. After mist-spraying, observation was done at certain time intervals and the fire extinguishing effect was assessed.

Observation on Test Site

| Burning Substance Tested: plastic tableware (10 g) | Pure Water Mist-Spray (0.2 mL per spray) | Mist-Spray with CFC-Free and Phosphorus-Free Aqueous Fire Extinguishing Agent added (0.1 mL per spray) |
|---|---|---|
| began mist-spraying after fire started | fire was extinguished after 10 sprays | fire was extinguished immediately and completely after 3 sprays |

As shown in the table above, the fire on the burning substance (plastic tableware) was not extinguished by the pure water mist-spray. The mist-spray with the agent added was able to extinguish fire rapidly and completely in a remarkably and relatively small amount.

Example 3

The 1 wt % aqueous solution of the CFC-free and phosphorus-free aqueous fire extinguishing agent diluted by distilled water in Example 1 was mist-sprayed to a region above or in the burning substance. After mist-spraying, observation was done at certain time intervals and the fire extinguishing effect was assessed.

| Observation on Test Site | | |
|---|---|---|
| Burning Substance Tested: vehicle tire fragments (10 g) | Pure Water Mist-Spray (0.2 mL per spray) | Mist-Spray with CFC-Free and Phosphorus-Free Aqueous Fire Extinguishing Agent added (0.1 mL per spray) |
| began mist-spraying after fire started | fire continued after 10 sprays<br>fire was extinguished completely after additional 2 mist-sprays with the agent added<br>fire smoke was hardly reduced | fire was extinguished completely after 4 sprays<br>fire smoke was reduced immediately |

As shown in the table above, the fire on the burning substance (vehicle tire fragments) was not extinguished by the pure water mist-spray. The mist-spray with the agent added was able to extinguish fire rapidly and completely in a remarkably and relatively small amount. In addition, the mist-spray with the agent added was able to reduce fire smoke immediately.

Example 4

The 1 wt % aqueous solution of the CFC-free and phosphorus-free aqueous fire extinguishing agent diluted by distilled water in Example 1 was mist-sprayed to a region above or in the burning substance. After mist-spraying, observation was done at certain time intervals and the fire extinguishing effect was assessed.

| Observation on Test Site | | |
|---|---|---|
| Burning Substance Tested: #150 solvent naphtha (10 mL) | Pure Water Mist-Spray (0.2 mL per spray) | Mist-Spray with CFC-Free and Phosphorus-Free Aqueous Fire Extinguishing Agent added (0.1 mL per spray) |
| began mist-spraying after fire started | fire continued after 10 sprays<br>fire was extinguished completely after additional 2 mist-sprays with the agent added<br>fire smoke was hardly reduced | fire was extinguished completely after 5 sprays<br>fire smoke was reduced immediately |

As shown in the table above, the fire on the burning substance (#150 solvent naphtha) was not extinguished by the pure water mist-spray. The burning substance (#150 solvent naphtha) was even scattered and deflagrated under the high temperature of fire. However, the mist-spray with the agent added was able to extinguish fire rapidly and completely in a remarkably and relatively small amount. In addition, the mist-spray with the agent added was able to reduce fire smoke immediately.

Example 5

The 1 wt % aqueous solution of the CFC-free and phosphorus-free aqueous fire extinguishing agent diluted by distilled water in Example 1 was mist-sprayed to a region above or in the burning substance. After mist-spraying, observation was done at certain time intervals and the fire extinguishing effect was assessed.

| Observation on Test Site | | |
|---|---|---|
| Burning Substance Tested: industrial kerosene (1000 mL) | Pure Water Mist-Spraying (23 ml per second) | Mist-Spray with CFC-Free and Phosphorus-Free Aqueous Fire Extinguishing Agent added (23 mL per second) |
| began mist-spraying after fire started for 45 seconds | fire continued after spraying for 153 seconds<br>fire was extinguished completely after mist-spray with the agent added sprayed for 10 seconds<br>fire smoke was hardly reduced | fire was extinguished completely after spraying for 97 seconds<br>fire smoke was reduced immediately |

As shown in the table above, the fire on the burning substance (industrial kerosene) was not extinguished by the pure water mist-spray. The burning substance (industrial kerosene) was even scattered and deflagrated under the high temperature of fire. However, the mist-spray with the agent added was able to extinguish fire rapidly and completely in a remarkably and relatively small amount. In addition, the mist-spray with the agent added was able to reduce fire smoke immediately.

In view of the results described above, the CFC-free and phosphorus-free aqueous fire extinguishing agent provided by the present invention is able to effectively inhibit combustion of the substances of types A and B, such as rubbers, plastics, solvents, industrial kerosene. Fires of the aforesaid substances can be extinguished completely. In addition, the CFC-free and phosphorus-free aqueous fire extinguishing agent provided by the present invention is able to reduce fire smoke rapidly. Thus, the CFC-free and phosphorus-free aqueous fire extinguishing agent provided by the present invention is very beneficial in increasing and improving the efficiency of firefighting, evacuation, safety and health of firefighters, and the environmental problems caused by fire.

Accordingly, the CFC-free and phosphorus-free aqueous fire extinguishing agent provided by the present invention comprises sulfosuccinic acid ester, which is an ionic surfactant having high wettability and permeability, and a wetting agent. During a fire extinguishing process, by enhancing the wettability of water and the affinity of water to the burning substance, the temperature of the burning substance can be lowered rapidly. The combustion of the burning substance can then be inhibited and prevented. The safety and environmental problems caused by fire smoke from combustion and all possible related health hazards can then be mitigated as well.

In addition, in comparison with the fire extinguishing methods using the conventional fire extinguishing agents, the fire extinguishing method using the CFC-free and phosphorus-free aqueous fire extinguishing agent provided by the present invention has the following advantages:

1. The CFC-free and phosphorus-free aqueous fire extinguishing agent provided by the present invention has high wettability. Thus, it can rapidly reduce the surface tension of water and increase the affinity of water to a burning substance. The temperature of the burning substance can then be lowered rapidly. The combustion of the burning substance can then be inhibited. The water consumed and polluted during a fire extinguishing process can then be reduced. In addition, the CFC-free and phosphorus-free aqueous fire extinguishing agent provided by the present invention can reduce fire smoke rapidly. Thus, the CFC-free and phosphorus-free aqueous fire extinguishing agent provided by the present invention is very beneficial in increasing and improving the efficiency of firefighting, evacuation, safety and health of firefighters, and the environmental problems caused by fire.

2. The CFC-free and phosphorus-free aqueous fire extinguishing agent provided by the present invention has high permeability. When the CFC-free and phosphorus-free aqueous fire extinguishing agent is sprinkled or mist-sprayed to a space containing a burning substance, the CFC-free and phosphorus-free aqueous fire extinguishing agent can penetrate the surface or into the interior of the burning substance in a short time. The affinity of water to the burning substance is enhanced. Hence, the temperature reduction of the burning substance can be accelerated and further combustion can be inhibited.

3. The CFC-free and phosphorus-free aqueous fire extinguishing agent provided by the present invention can be prepared using water in advance or on a fire site. The CFC-free and phosphorus-free aqueous fire extinguishing agent can be sprinkled or mist-sprayed to extinguish fire depending on the fire site and the property of the burning substance. Therefore, the CFC-free and phosphorus-free aqueous fire extinguishing agent have advantages, such being highly flexible, highly convenient, and highly economical.

4. The CFC-free and phosphorus-free aqueous fire extinguishing agent provided by the present invention is biodegradable (can biodegrade very fast) and is not hazardous to the environment.

5. The CFC-free and phosphorus-free aqueous fire extinguishing agent provided by the present invention can be sprayed in a small amount. The CFC-free and phosphorus-free aqueous fire extinguishing agent does not contain any fluorine-containing substances, phosphorusous-containing substances, heavy metals, and fluoride ions. The CFC-free and phosphorus-free aqueous fire extinguishing agent will not be hazardous to human under appropriate use.

It should be clearly understood that the embodiments described above are illustrative only and it is not intended to limit the scope of the present invention.

What is claimed is:

1. A method for extinguishing fire, comprising:

(A) preparing a CFC-free and phosphorus-free aqueous fire extinguishing agent using a composition, wherein the composition consists of:

1-70 wt % of a sulfosuccinic acid ester;

1-30 wt % of an alkyl diol; and rest in water;

(B) diluting the CFC-free and phosphorus-free aqueous fire extinguishing agent by water to form an aqueous solution; and (C) spraying the aqueous solution to a space containing a burning substance;

wherein the fire extinguishing agent does not contain any fluorine-containing substances or phosphorus-containing substances.

2. The method of claim 1, wherein the sulfosuccinic acid ester is an alkyl sulfosuccinic acid ester.

3. The method of claim 2, wherein the alkyl sulfosuccinic acid ester is a monoalkyl sulfosuccinic acid ester, a dialkyl sulfosuccinic acid ester, a multi-alkyl sulfosuccinic acid ester, or a combination thereof.

4. The method of claim 3, wherein the monoalkyl sulfosuccinic acid ester has an alkyl group having a carbon chain of 1 to 18 carbon atoms.

5. The method of claim 3, wherein the dialkyl sulfosuccinic acid ester has an alkyl group having a carbon chain of 1 to 18 carbon atoms.

6. The method of claim 2, wherein the alkyl sulfosuccinic acid ester has the following formula:

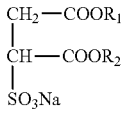

wherein $R_1$ and $R_2$ are different or same alkyl groups.

7. The method of claim 1, wherein the CFC-free and phosphorus-free aqueous fire extinguishing agent is free of heavy metals and chloride ions.

8. The method of claim 1, wherein the CFC-free and phosphorus-free aqueous fire extinguishing agent is biodegradable.

9. The method of claim 1, wherein a weight ratio of the CFC-free and phosphorus-free aqueous fire extinguishing agent to water is 1:100000 to 1:10.

10. The method of claim 1, wherein the aqueous solution is sprayed to the space containing the burning substance by sprinkling or mist-spraying.

11. The method of claim 1, wherein the aqueous solution is sprayed from top to bottom in the air to the space containing the burning substance.

12. The method of claim 1, wherein the burning substance is a gas, a liquid, a solid, or a combination thereof.

13. The method of claim 1, wherein the space containing the burning substance is a region above or in the burning substance.

14. The method of claim 1 wherein the alkyl diol is propylene glycol or diethylene glycol.

15. The method of claim 1 wherein the fire to be extinguished comprises burning rubber bands, plastic tableware, vehicle tire fragments naphtha or kerosene.

16. The method of claim 15, wherein the fire comprise burning naphtha or kerosene.

* * * * *